US007052437B2

(12) United States Patent
Köhler

(10) Patent No.: US 7,052,437 B2
(45) Date of Patent: May 30, 2006

(54) ROPE GAME DEVICE

(75) Inventor: Karl Heinz Köhler, Berlin (DE)

(73) Assignee: Berliner Seilfabtrik GmbH & Co., Berlin (DE)

( * ) Notice: Subject to any disclaimer, the term of this patent is extended or adjusted under 35 U.S.C. 154(b) by 88 days.

(21) Appl. No.: 10/470,339

(22) PCT Filed: Jan. 31, 2002

(86) PCT No.: PCT/EP02/01024

§ 371 (c)(1),
(2), (4) Date: Dec. 4, 2003

(87) PCT Pub. No.: WO02/074392

PCT Pub. Date: Sep. 26, 2002

(65) Prior Publication Data

US 2004/0116254 A1 Jun. 17, 2004

(30) Foreign Application Priority Data

Jan. 31, 2001 (DE) ..... 101 05 463

(51) Int. Cl.
*A63B 22/00* (2006.01)

(52) U.S. Cl. ..... 482/51; 482/35

(58) Field of Classification Search ..... 482/51, 482/23, 33–36, 148, 542.6; 52/648.1
See application file for complete search history.

(56) References Cited

U.S. PATENT DOCUMENTS 3,970,301 A * 7/1976 Lehmann ..... 482/35
4,614,502 A * 9/1986 Nelson ..... 446/119
5,330,400 A * 7/1994 Huberman ..... 482/35
6,551,216 B1 * 4/2003 Rennex ..... 482/35

FOREIGN PATENT DOCUMENTS

| | | |
|---|---|---|
| DE | 11 11 554 | 7/1961 |
| DE | OS 2064791 | * 12/1970 |
| DE | 2 064 791 | 6/1972 |
| DE | 2 316 141 | 10/1974 |
| DE | 88 02 141 U1 | 5/1988 |
| DE | 299 11 278 U1 | 1/2000 |
| DE | 199 14 192 A1 | 10/2000 |
| JP | 04-108463 | * 4/1992 |

OTHER PUBLICATIONS

Abstract of DE 19914192 from EPO website database.
Abstract of DE 299 11 278 U1 from Derwent database, Derwent Access No. 2000-148830.

* cited by examiner

*Primary Examiner*—Danton D. DeMille
*Assistant Examiner*—Tam Nguyen
(74) *Attorney, Agent, or Firm*—Norris McLaughlin & Marcus PA

(57) ABSTRACT

Known climbing frames having a support frame, in which a rope net is rigged, are not very attractive as individual playing devices, as no considerable 3-dimensional net volume is provided and on the other hand as the device cannot be combined by modular elements to larger units.

According to the present embodiment, the support frame consists of at least one pentagonal frame element, wherein a separate rope net is rigged within each frame element. The frame elements can thus be assembled in a modular manner to form complex 3-dimensional structures.

6 Claims, 22 Drawing Sheets

ROPE GAME DEVICE

The invention relates to a rope game device with a support frame and a rope net rigged up within the support frame.

Climbing nets made from ropes have as climbing devices for children play grounds as well as sport and leisure facilities for climbing, travelling along a rope by the hands and swinging a large importance for playing enjoyment.

Climbing frames for children with a support frame determining the outer contour of the frame and a rope net rigged up therewithin are known for example from DE-A 2 064 791. Between the knot points of the support frame, formed as a cuboid or as a octahedron, ropes are rigged as connection elements. In this case also pressure rods of the support frame can be partially omitted and can be substituted by an inner pressure rod within the 3-dimensional rope net. The 3-dimensional net becomes then as a whole elastic and can swing.

The frame shape described there on the basis of a rectangular as an individual game device, is, however, not very attractive, as no considerable 3-dimensional net volume results, on the other hand the device cannot be combined by means of a modular construction to a larger unit, as besides a multiplication of the individual game device no effect is achieved in reference to the design of attractive 3-dimensional forms. Because of this, in larger game devices, support frames, in the shape of a polyhedron are used, in which inner space a single larger rope net is rigged.

The net structure shown in DE-A 2 064 791 is, further, because of partially three ropes, intersecting each other in one point, expensive to be manufactured, and furthermore, includes the danger, that dangerous and in view of the valid safety standards, not allowed angles are formed.

It is the object of the invention to provide a rope game device of the above named type, by which a high play value is ensured by means of a sufficient 3-dimensional net volume, which can be enlarged modularly to a larger unit and in which no angles, which are not allowed, are formed between the ropes.

The object is solved according to the invention by the features of claim 1. Embodiments of the invention formed according to the purpose are subject of the dependent claims.

According to this, the support frame consists of at least one pentagonal frame element, wherein within each frame element a separate rope net is rigged.

The invention has the advantage, that the pentagonal frame elements can be attached to each other in any suitable way, wherein the imagined planes, formed by the pentagons, can be arranged to each other at an angle, so that complex 3-dimensional forms can be achieved. Thus, the frame elements can be combined to a dodecahedron, parts thereof or to other tent-like forms, wherein these form structures can again be attached to each other in series. As in each frame element an individual rope net is rigged, the frame elements can at least be partially pre-assembled and combined modularly.

For connecting the frame elements as well as for rigging the individual ropes, well known hollow ball connectors are used. Their inner faces are already prepared for common connection angles. The openings allow the assembly of rods with common tools. By means of closure means, the openings are protected against the access by unauthorised persons or against the weather.

The invention has the further advantage, that by means of the use of a 3-dimensional frame work with large hollow balls as connectors as well as by means of the pentagonal increased number of rigging possibilities a 3-dimensional net with a large volume and which can be rigged equally, is produced, without producing dangerous angles, because of the 3-dimensional narrowness, at the rigging knots.

The balanced rigging of the inner 3-dimensional net enables to ensure a rope geometry which is optical as well as technically advantageous for climbing, wherein no not allowed angles between the ropes are produced.

In the following the invention is described in detail by means of embodiments. In the attached drawings FIG. 1 shows an individual frame element with an inner 3-dimensional net according to the invention in a perspective view, FIG. 2 shows the frame element of FIG. 1 in a top view, FIG. 3 shows the frame element of FIG. 1 in a tipped manner in a perspective view, FIG. 4 shows a frame element with a 2-dimensional net and additional guys, FIG. 5 shows a rope game device consisting of two frame elements attached in series to each other in a perspective view, FIG. 6 shows the rope game device of FIG. 5 in a top view, FIG. 7 shows a rope game device consisting of three frame elements attached in series to each other, in a perspective view, FIG. 8 shows the rope game device of FIG. 7 in a top view, FIG. 9 shows a rope game device consisting of four frame elements attached in series to each other, in a perspective view, FIG. 10 shows the rope game device of FIG. 9 in a top view, FIG. 11 shows a rope game device consisting of five frame elements attached in series to each other, in a perspective view, FIG. 12 shows the rope game device of FIG. 11 in a top view, FIG. 13 shows a rope game device consisting of six frame elements attached in series to each other, in a perspective view, FIG. 14 shows the rope game device of FIG. 13 in a top view, FIG. 15 shows a rope game device also consisting of six frame elements attached in series to each other in a different arrangement in a perspective view, FIG. 16 shows the rope game device of FIG. 15 in a top view, FIG. 17 shows a rope game device consisting of eight frame elements attached in series to each other, in a perspective view, FIG. 18 shows the rope game device of FIG. 17 in a top view, FIG. 19 shows a rope game device consisting of nine frame elements attached in series to each other in a perspective view, FIG. 20 shows the rope game device of FIG. 19 in a top view, FIG. 21 shows a rope game device consisting of six combinations consisting according to FIGS. 7 and 8 each of three parts, in a perspective view, FIG. 22 shows the rope game device of FIG. 21 in a top view.

FIGS. 1 and 2 show a single frame element, consisting of five frame rods 1, connected by means of first set of hollow ball connectors 2 in a common plane. Within the frame element a 3-dimensional net 3 is rigged by rapes, in which the lower 22 and upper 20 rope net knots are tensioned against each other by means of a pressure rod 4, for which second set of hollow ball connectors 22, 20 serve. The 3-dimensional net 3 can, because of this, swing as a whole, what immensely increases the adventure value during climbing activities.

FIG. 3 shows a view of the frame element from a different perspective.

FIG. 4 shows a frame element, in which a 2-dimensional net 5 is rigged. Additionally, again a pressure rod 4 is provided, arranged perpendicular to the net face and which is held by additional guys 6. The guys 6 engage as in the above described embodiment on the second set of hollow ball connectors 22, 20.

The further drawings show rope game devices as combinations from several frame elements, respectively, wherein in the figures, because of clarity, no reference numerals are used any more.

FIG. 5 shows a rope game device consisting of two frame elements, wherein the planes, formed by the respective frame rods 1, can be arranged to each other at an angle in such a way, that, respectively, one frame rod 1 of each frame element is arranged in the abutment plane. In this case, support piles, which engage on individual hollow ball connectors 2 of the first set, may serve for the further support of the rope game device.

Figure 1:
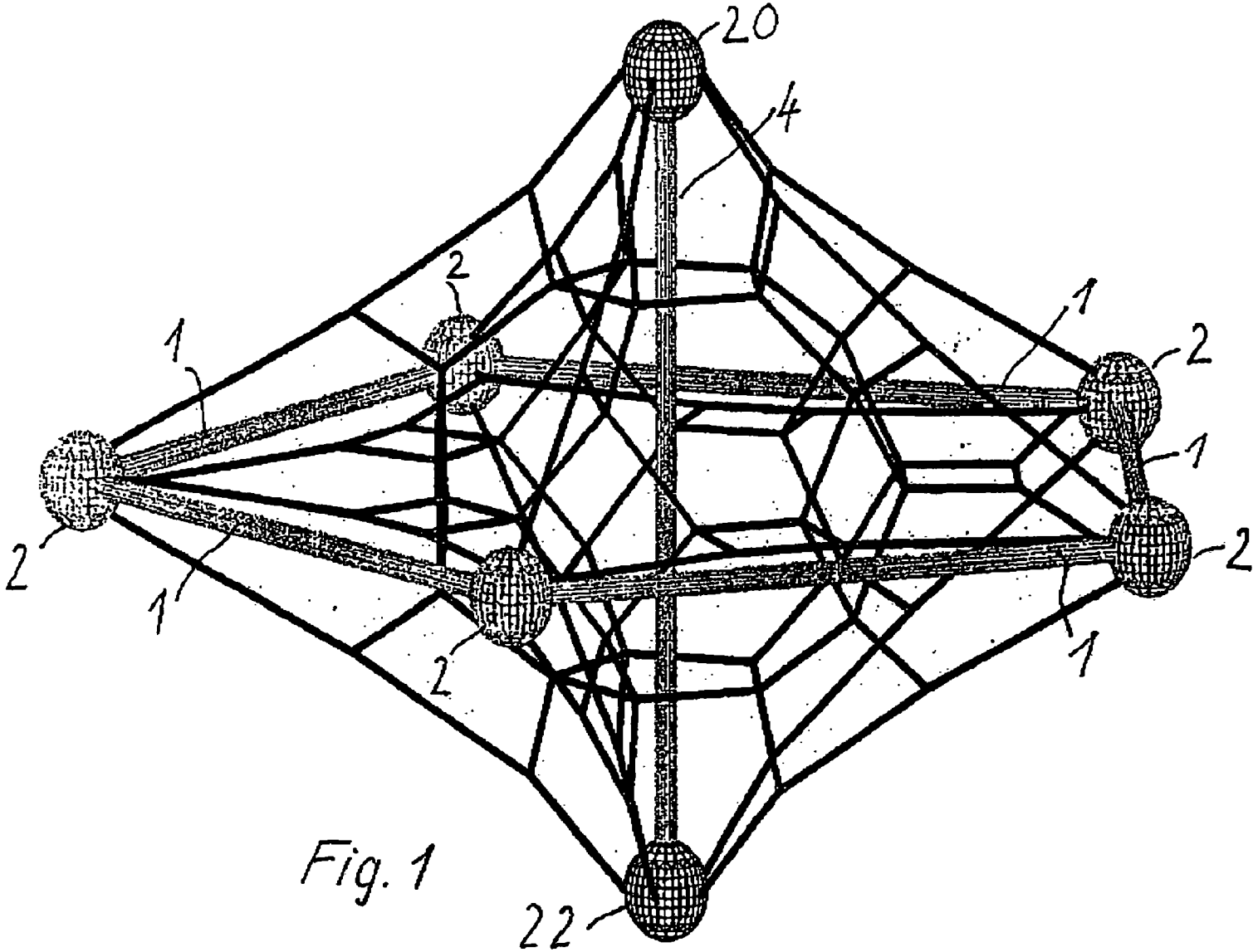
Figure 2:
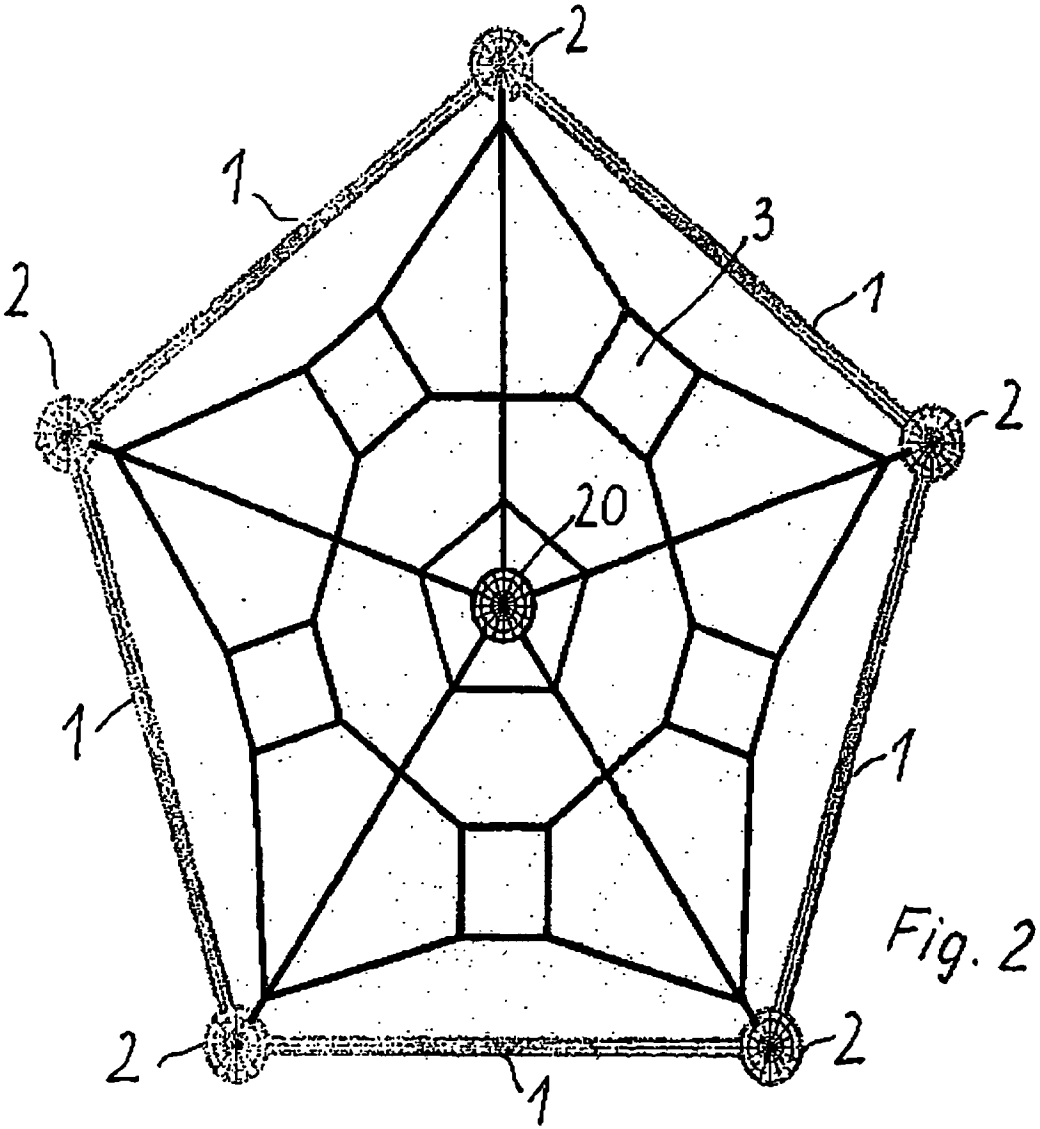
Figure 3:
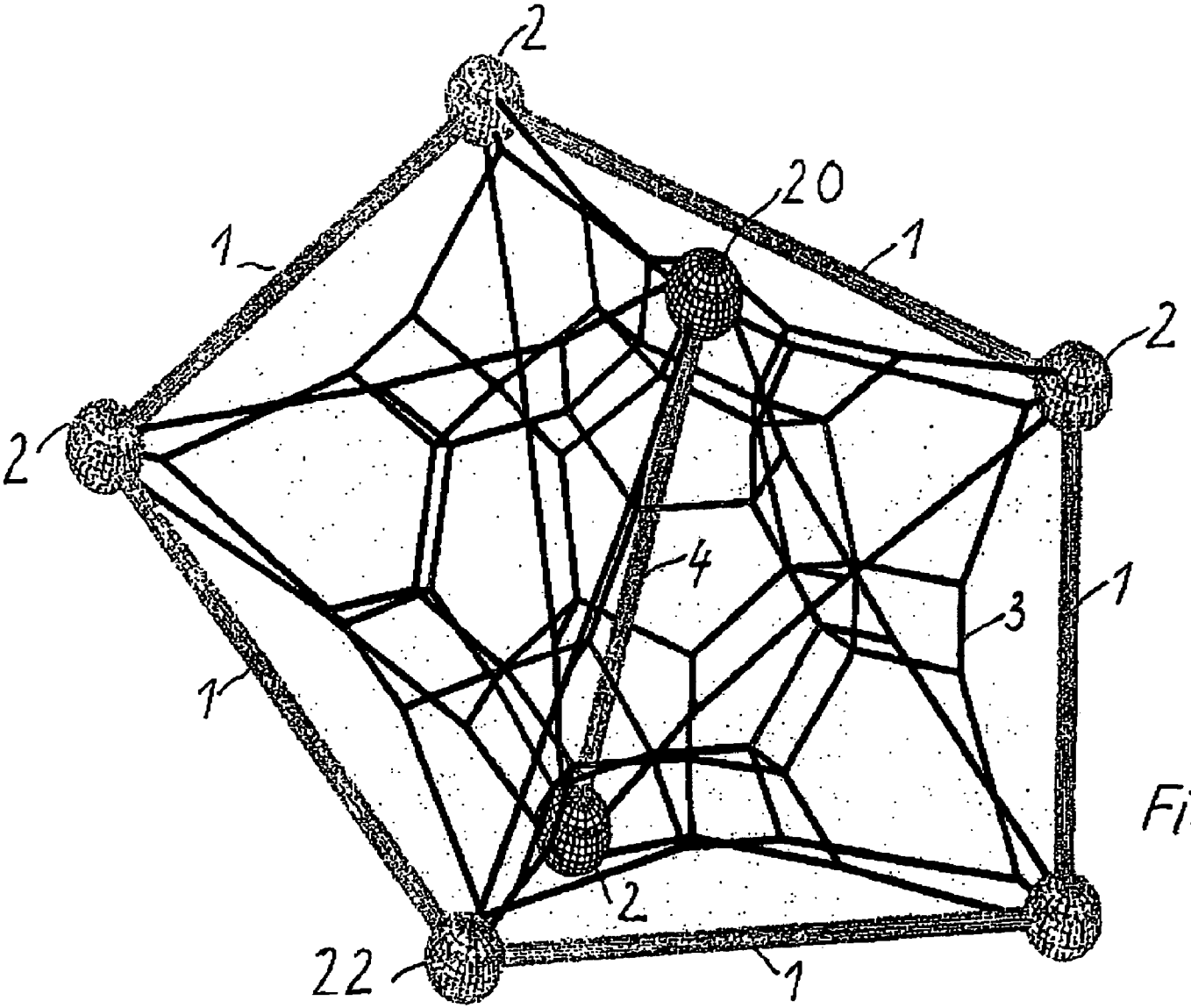
Figure 4:
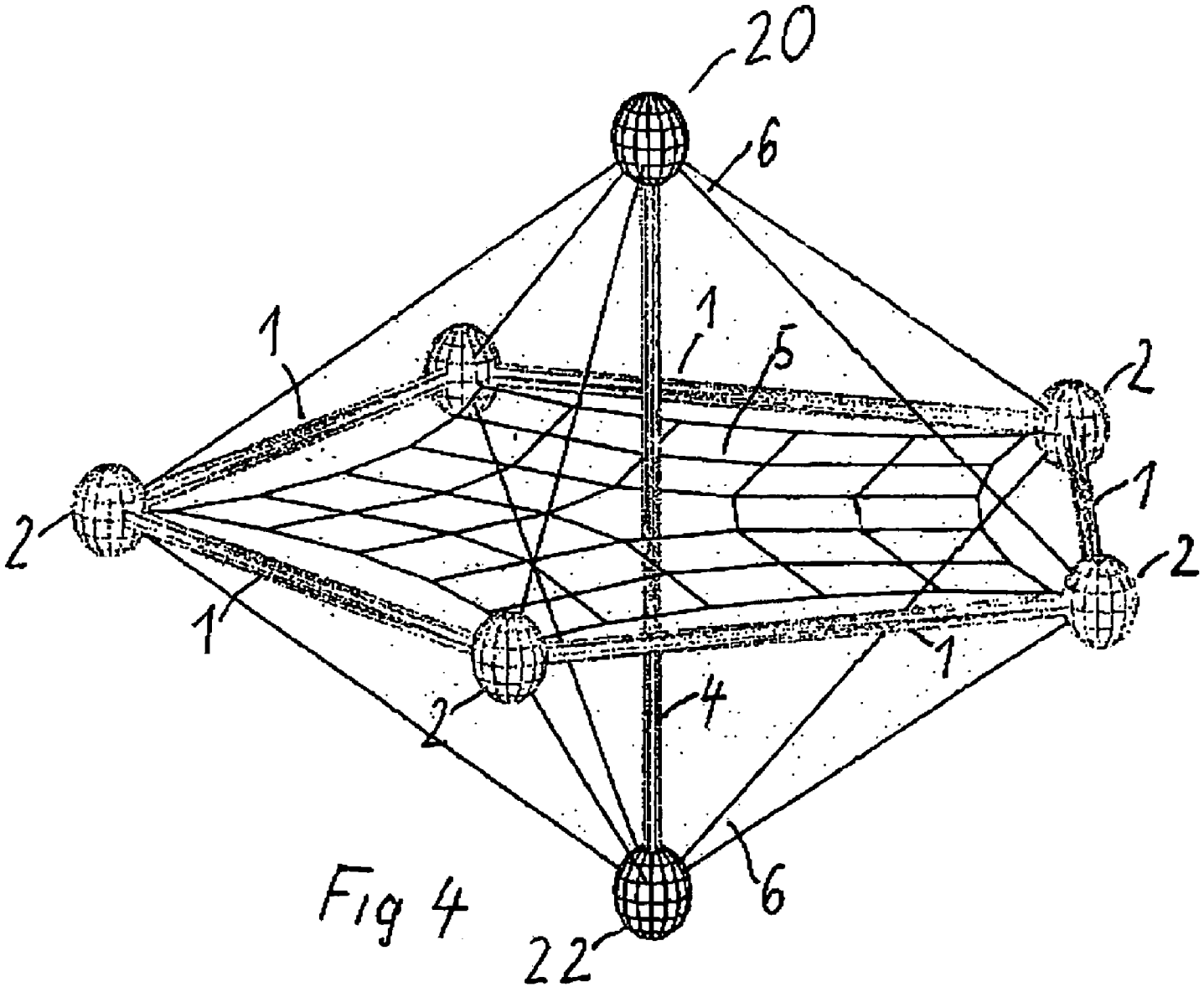
Figure 5:
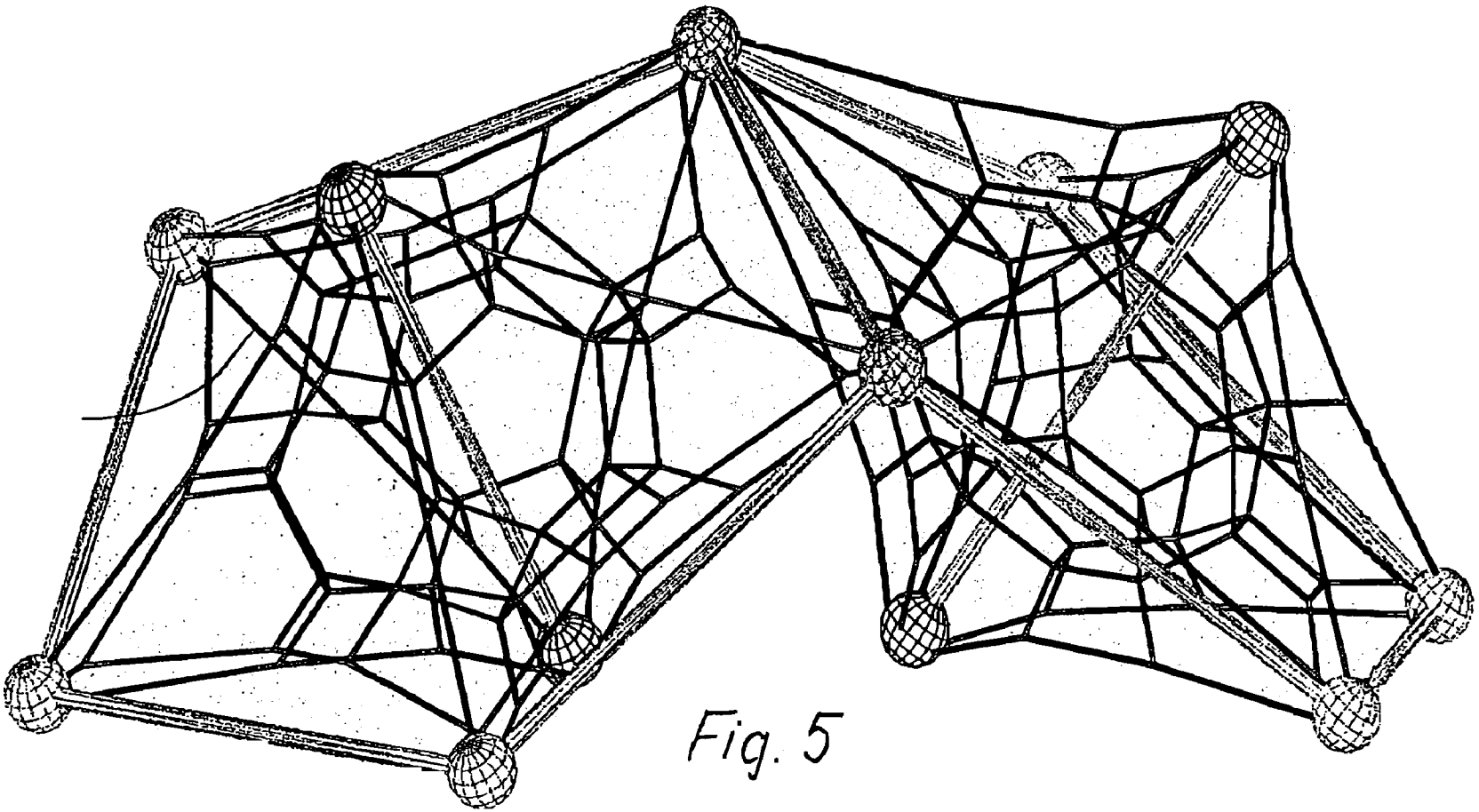
Figure 6:
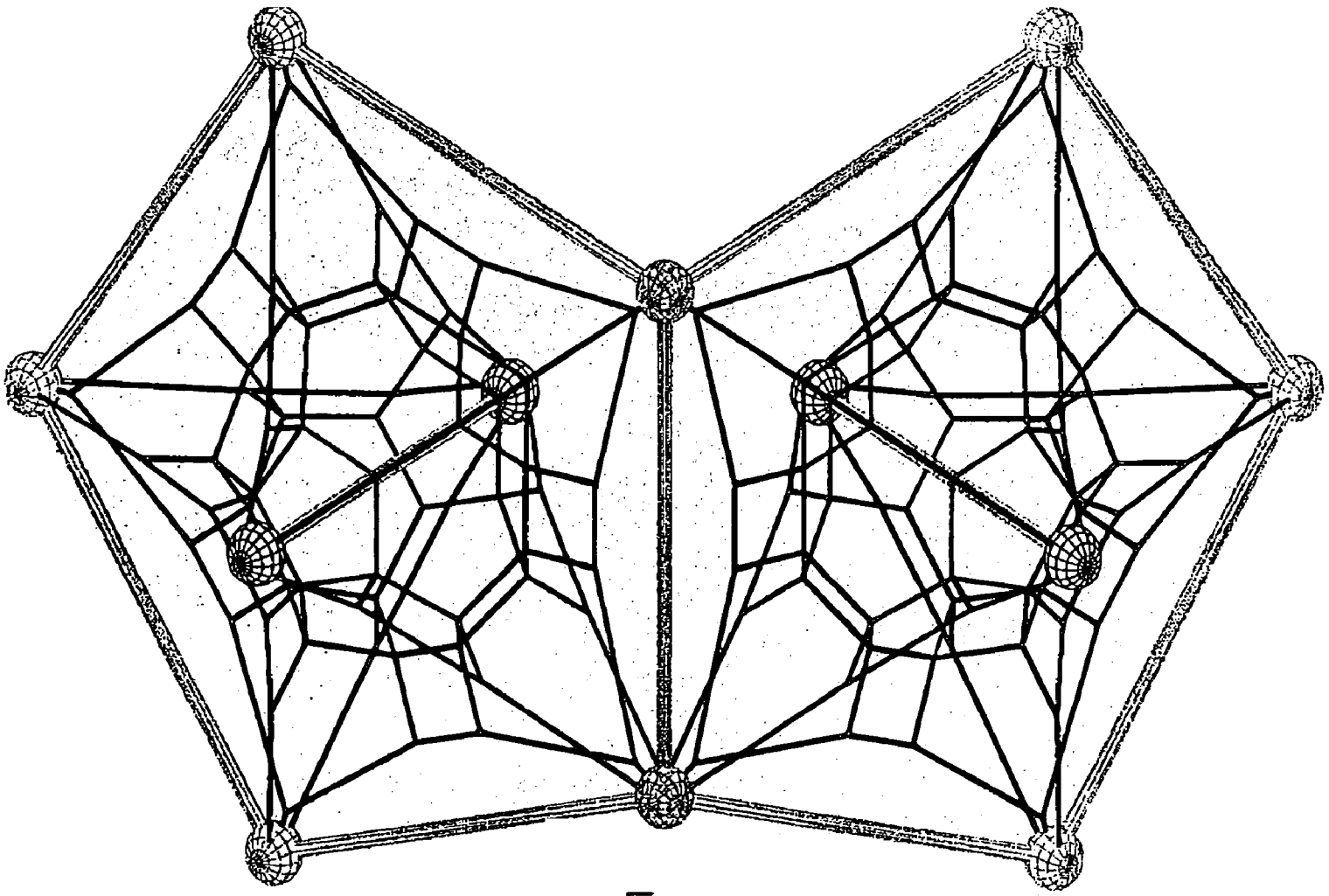
FIG. 6 shows this game device in a top view.
Figure 7:
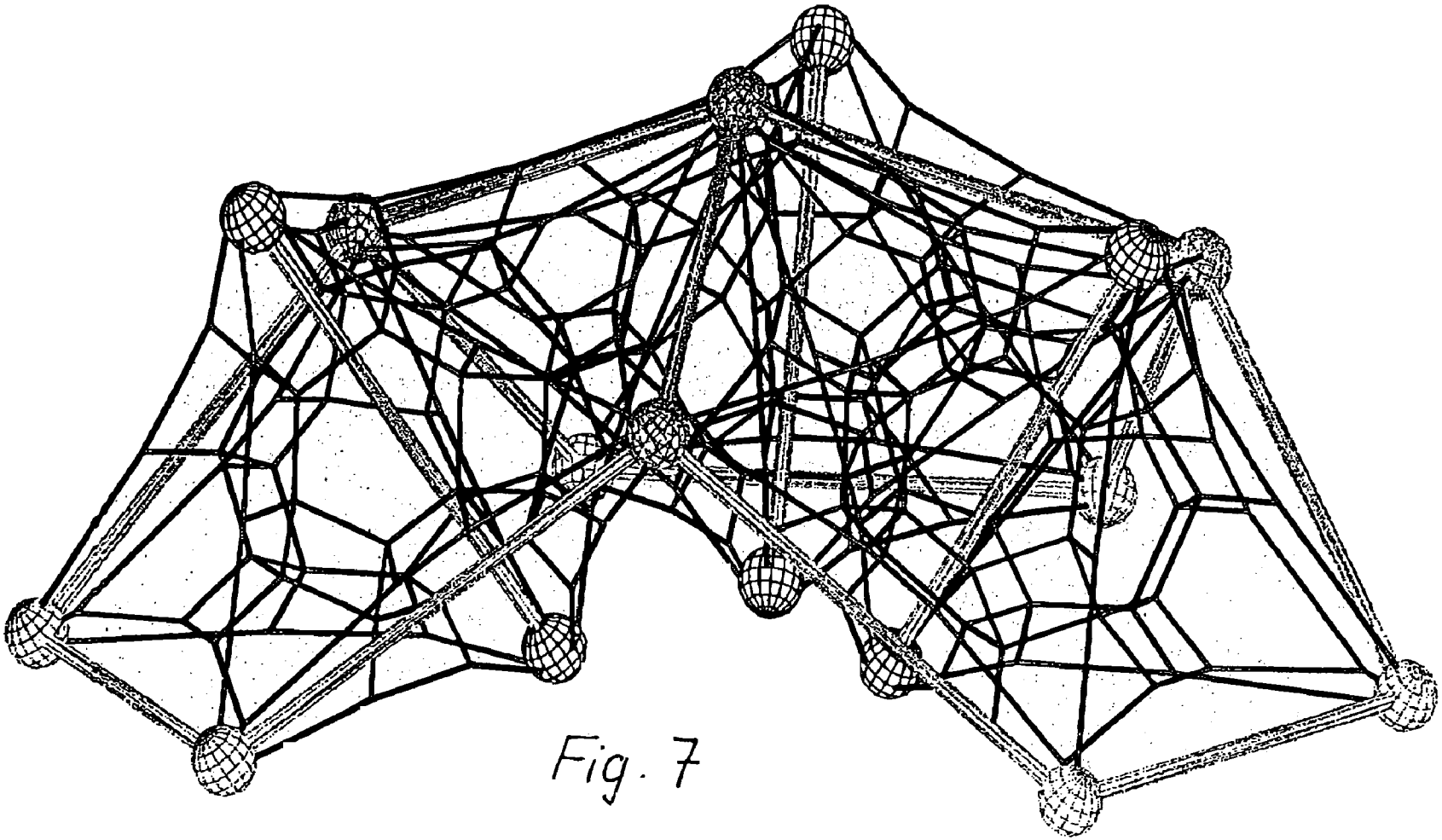
FIGS. 7 and 8 show an example for a rope game device, combined from three frame elements, wherein a tent-like construction is produced.
Figure 8:
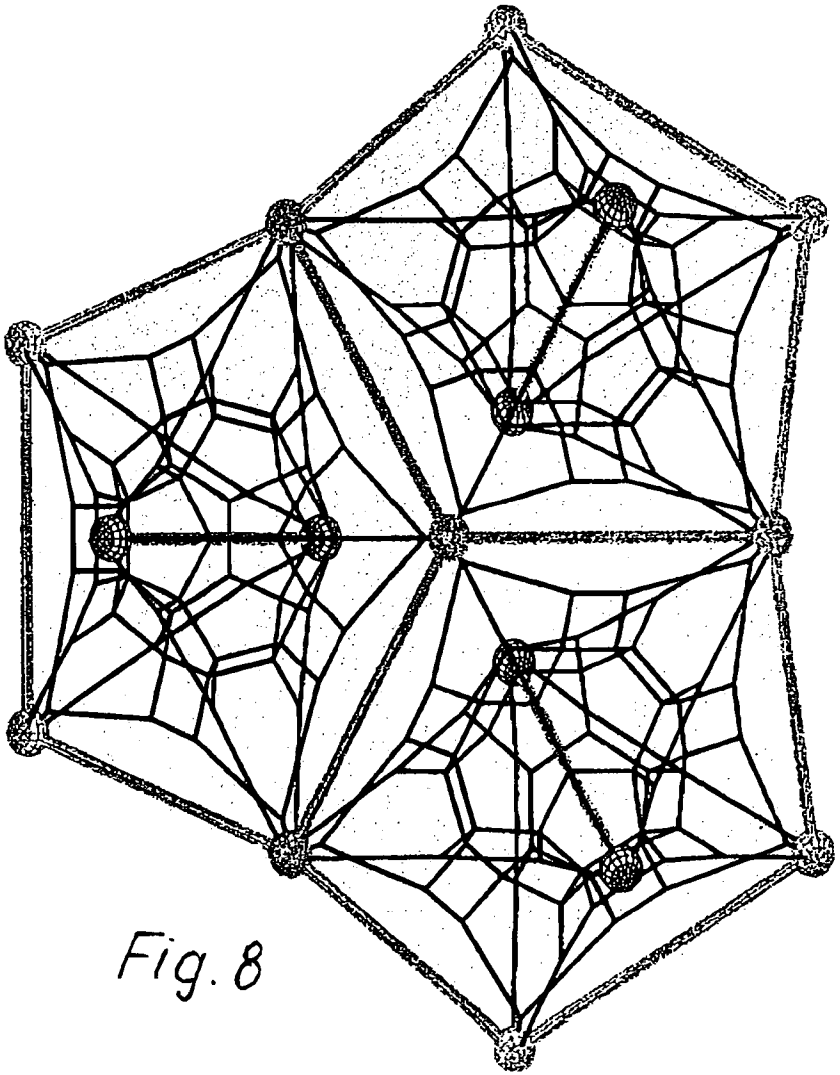
Figure 9:
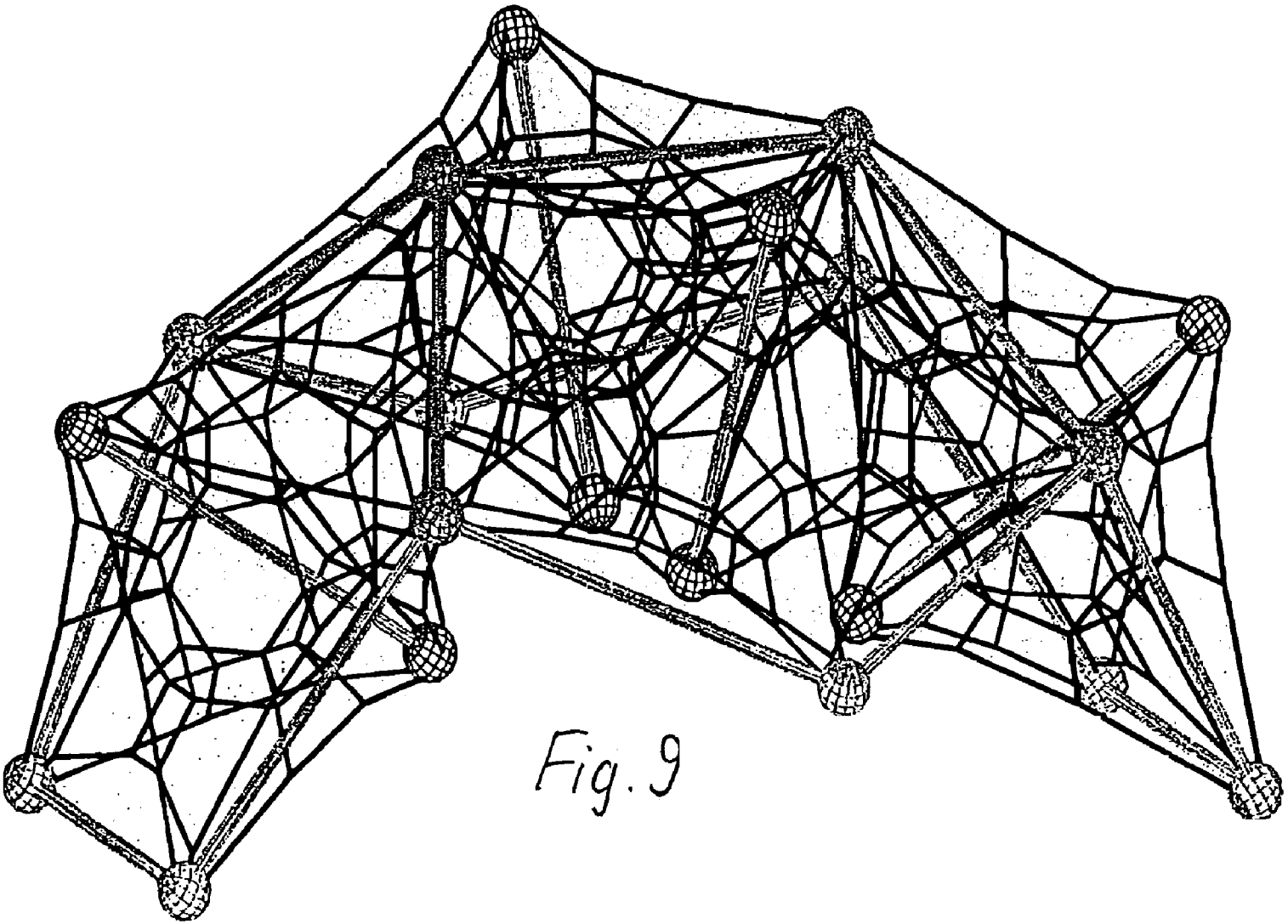
Figure 10:
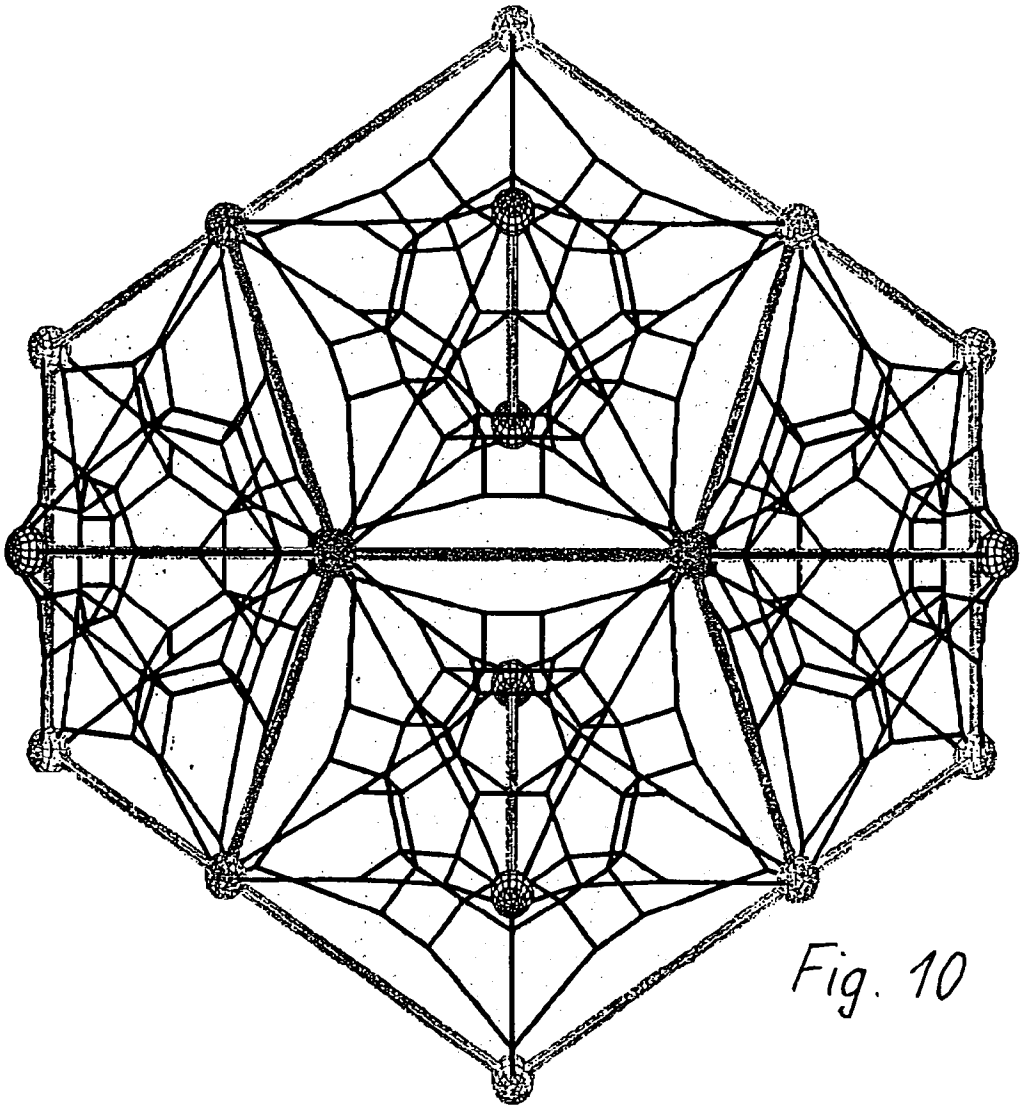

Similar 3-dimensional constructions are produced according to FIGS. 9 and 10 by a combination consisting of four frame elements.

Figure 11:
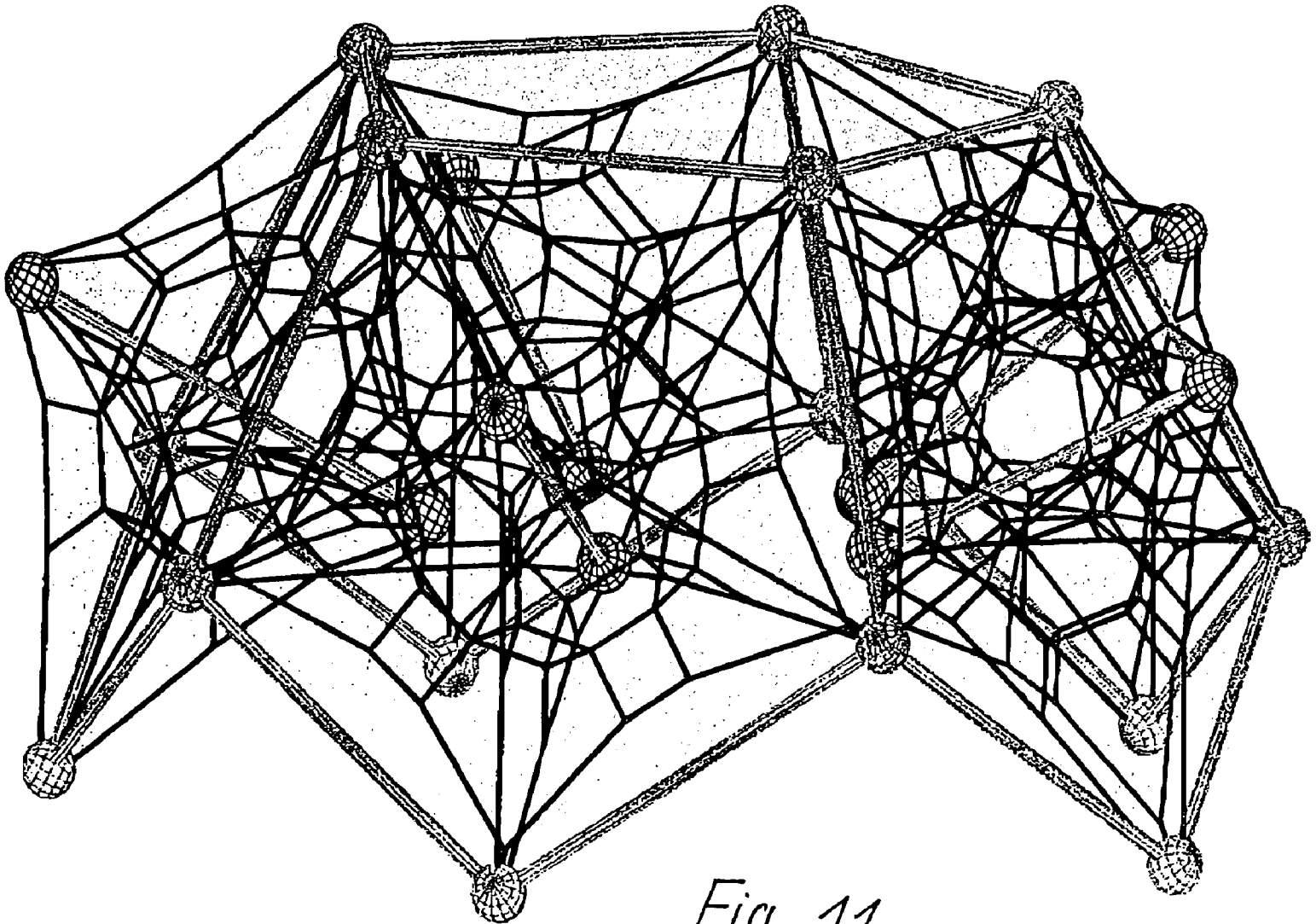
Figure 12:
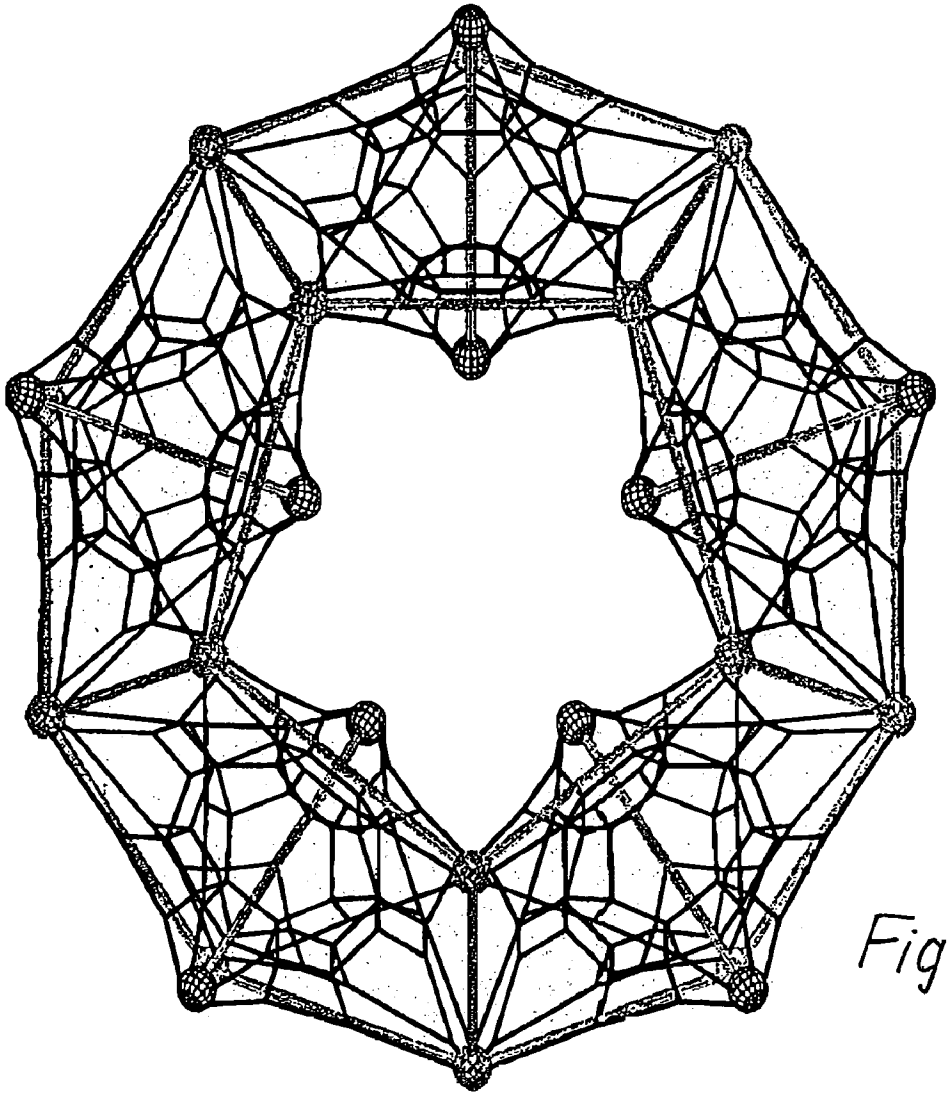
Figure 13:
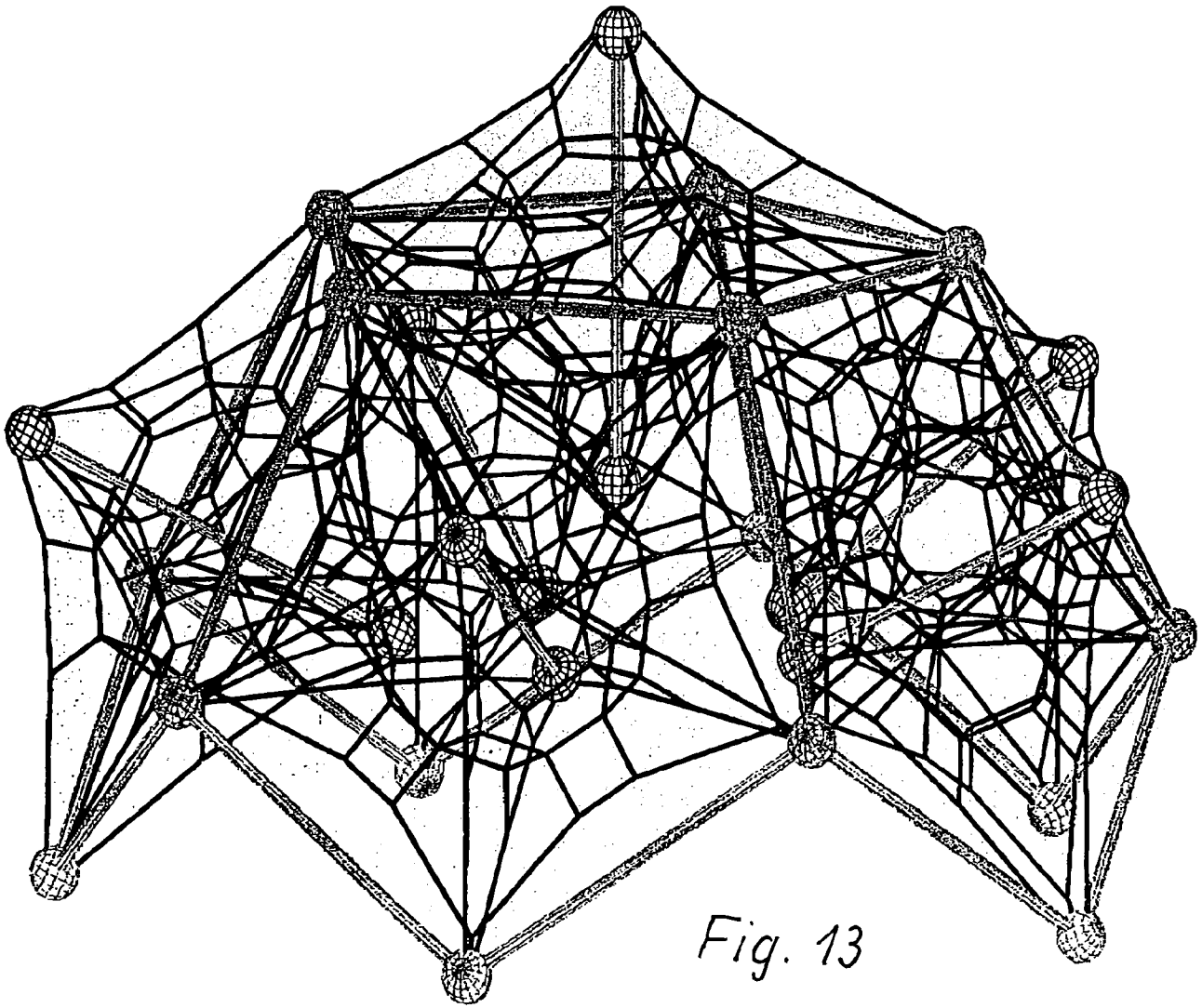
Figure 14:
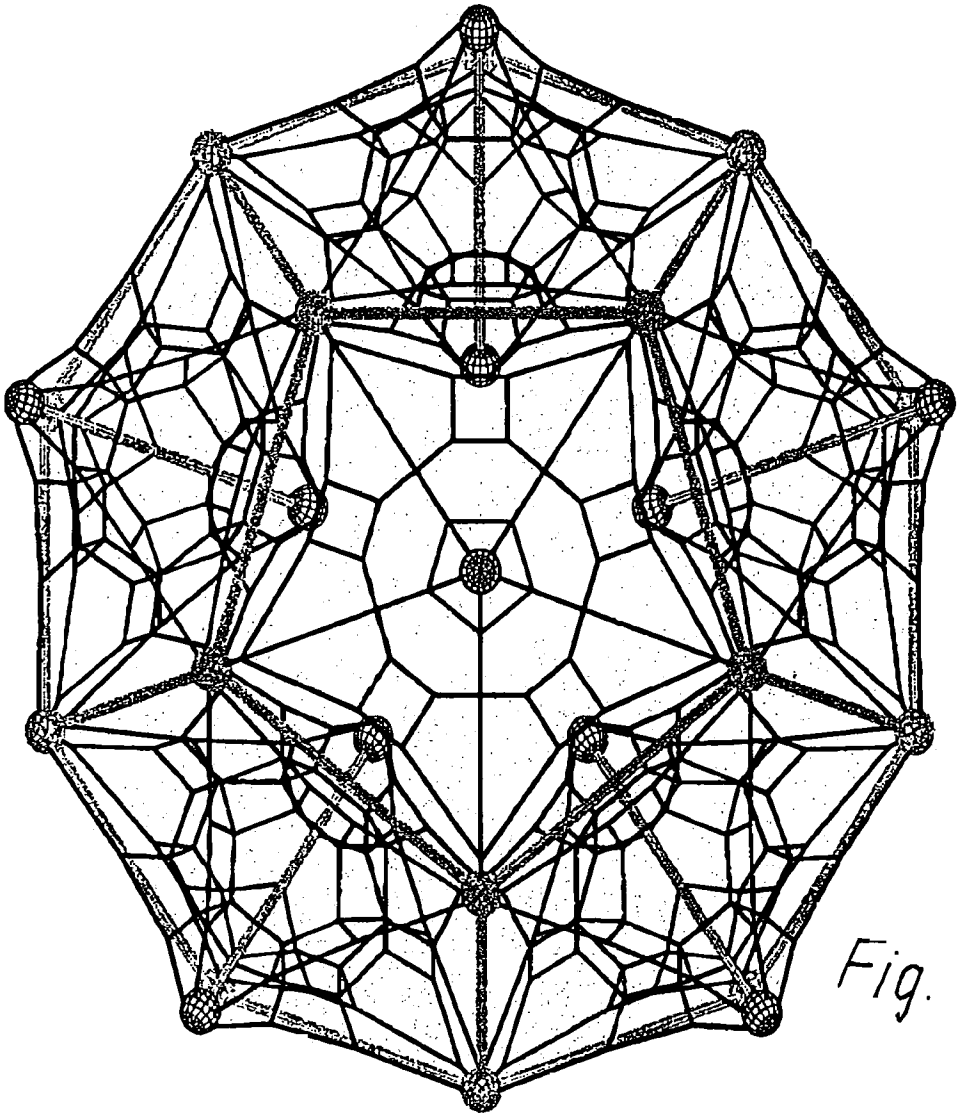

The five frame elements of FIGS. 11 and 12 are combined to a ring, which according to the arrangement of FIGS. 13 and 14 can also be closed at the top by means of a sixth frame element, so that a ball-segment-like 3-dimensional construction is achieved.

Figure 15:
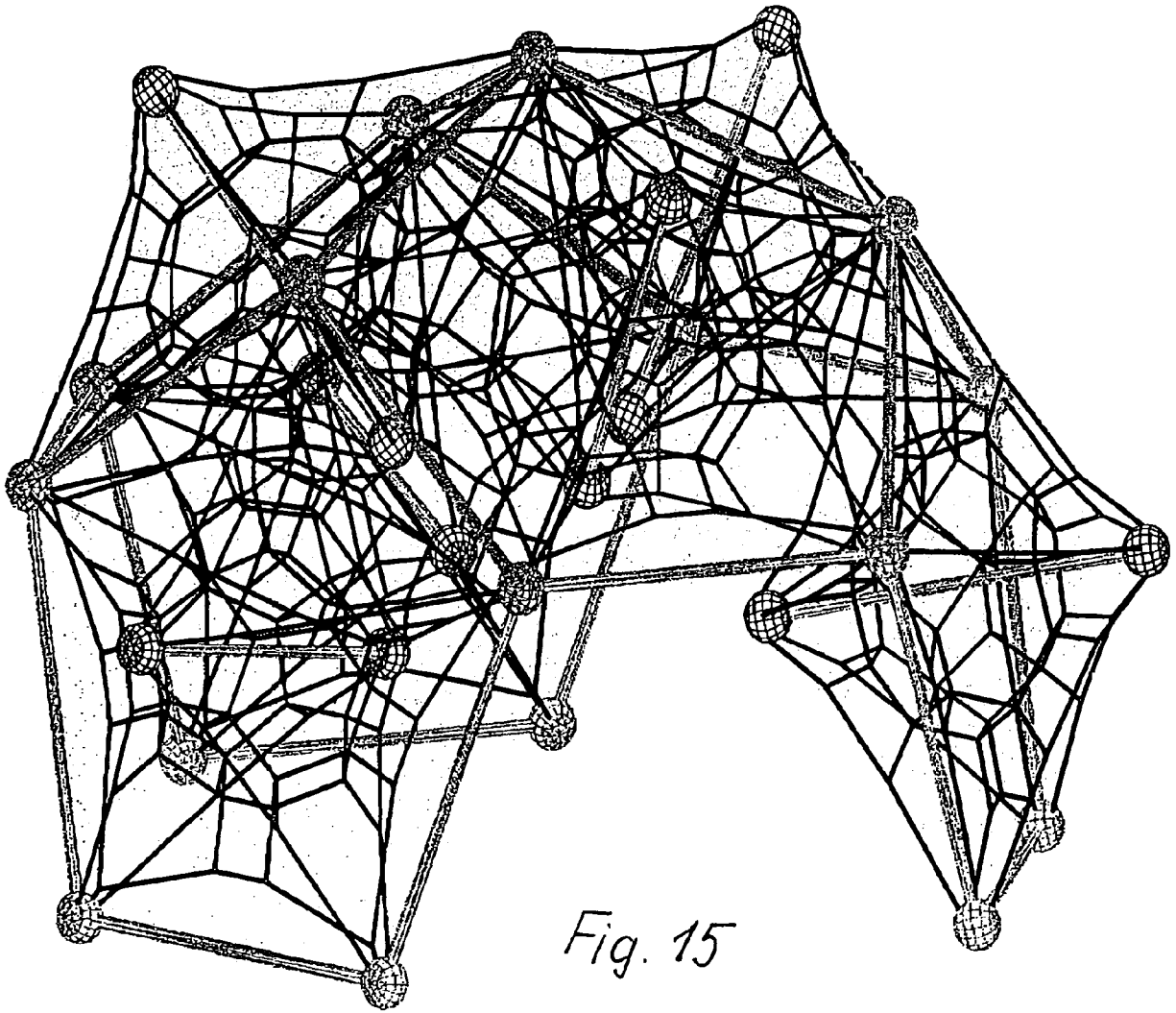
Figure 16:
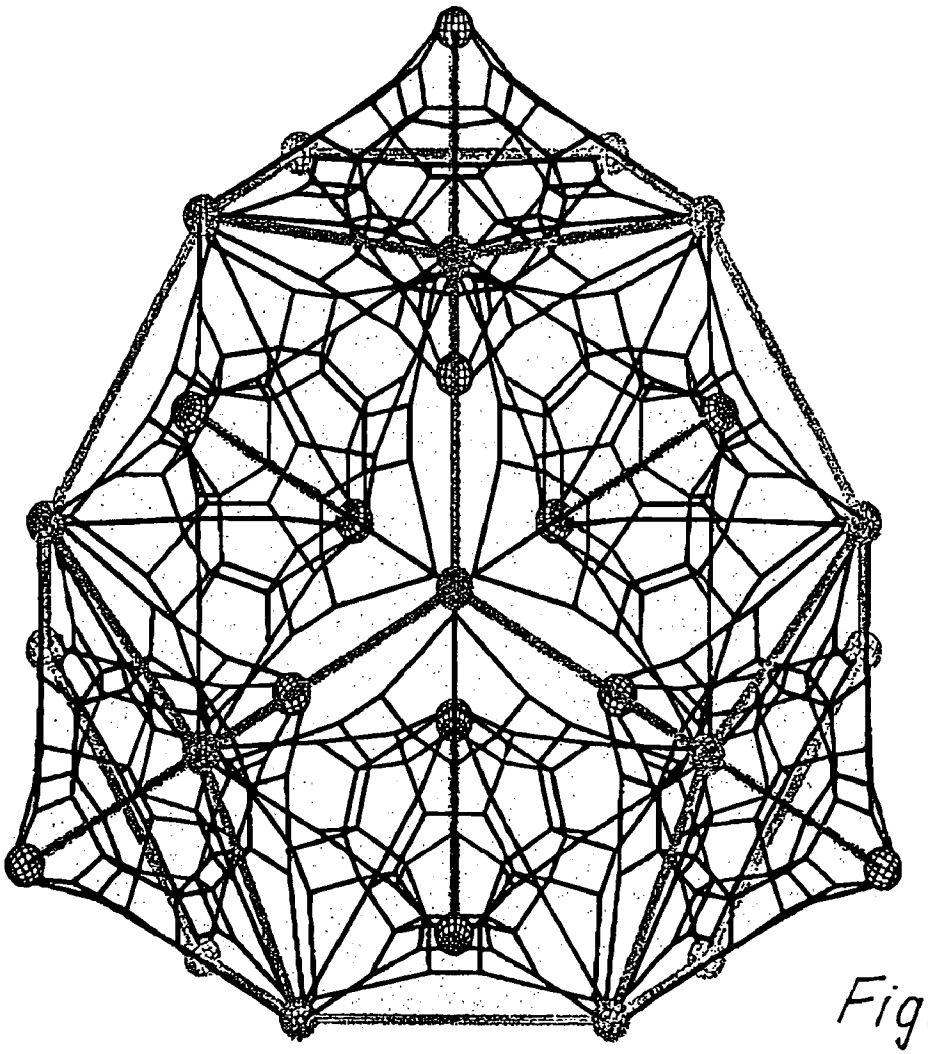
Figure 17:
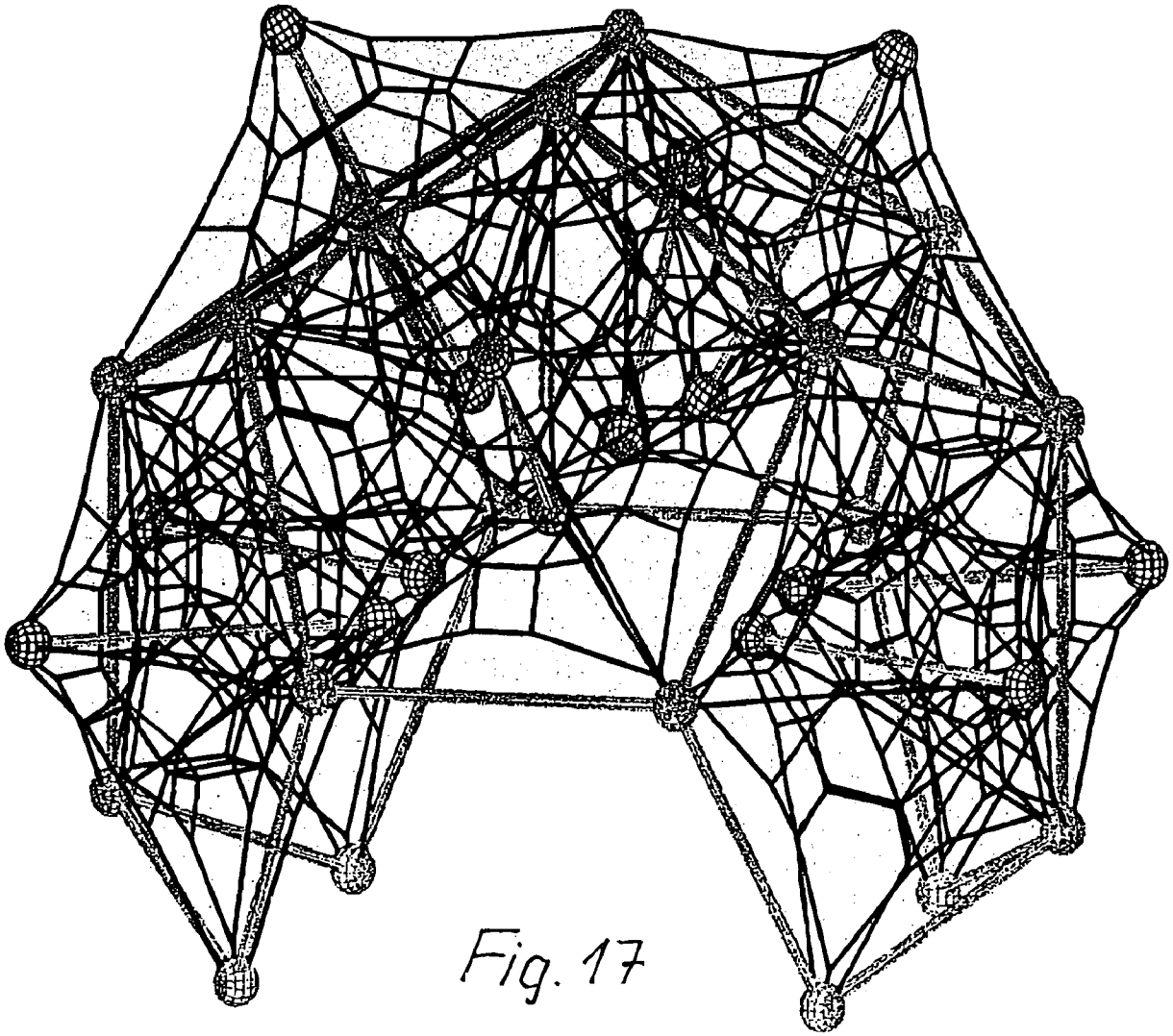
Figure 18:
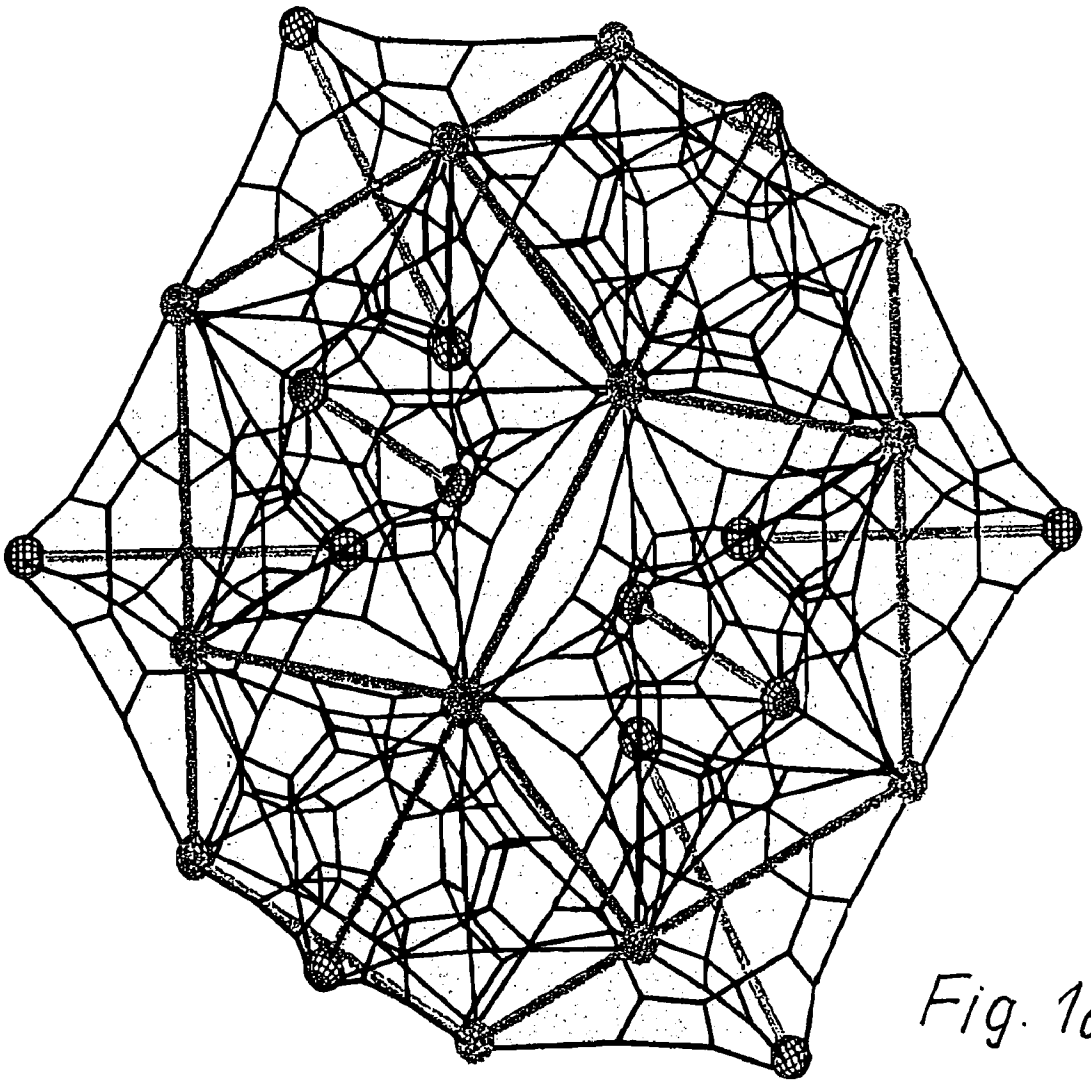
Figure 19:
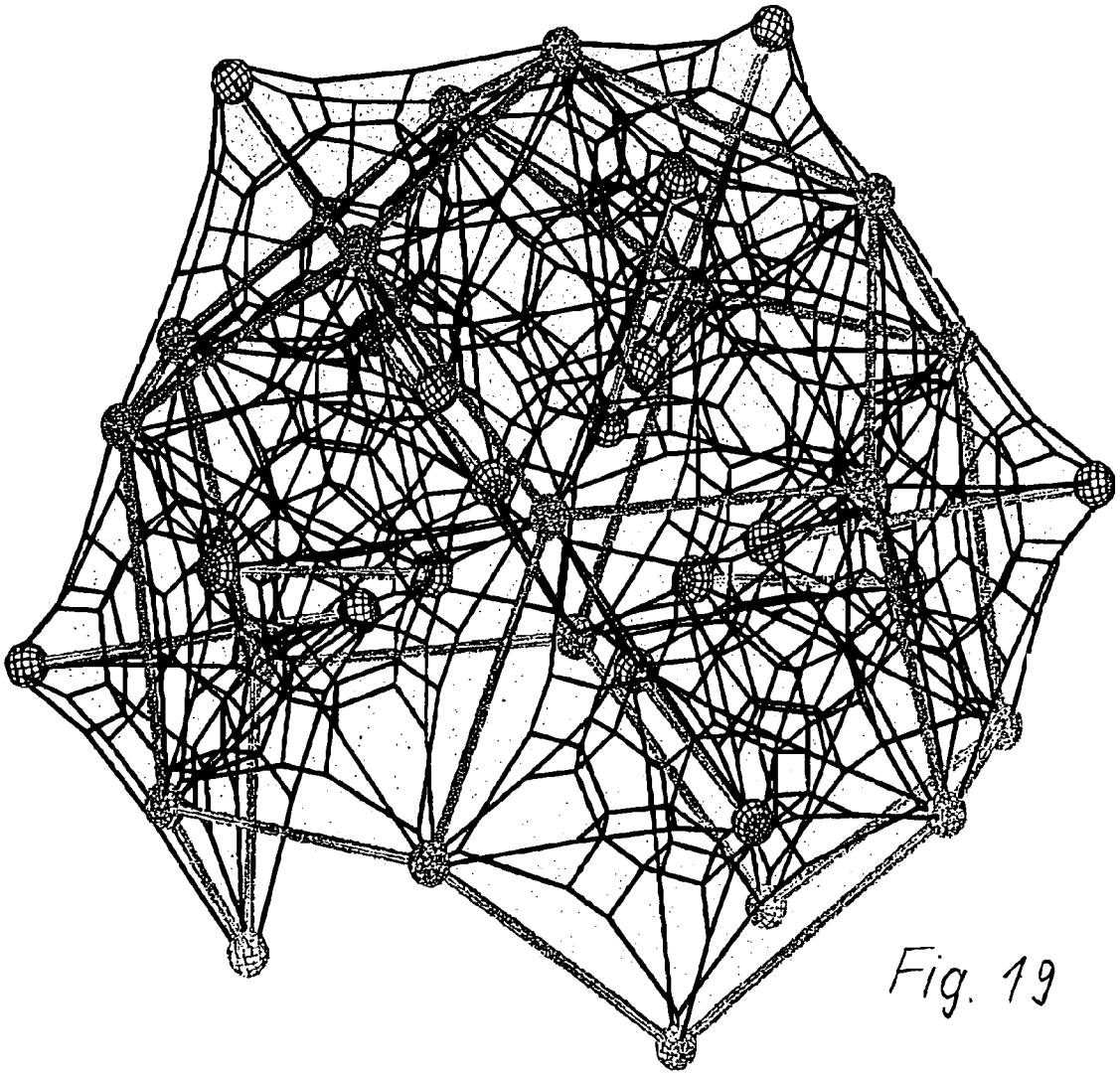
Figure 20:
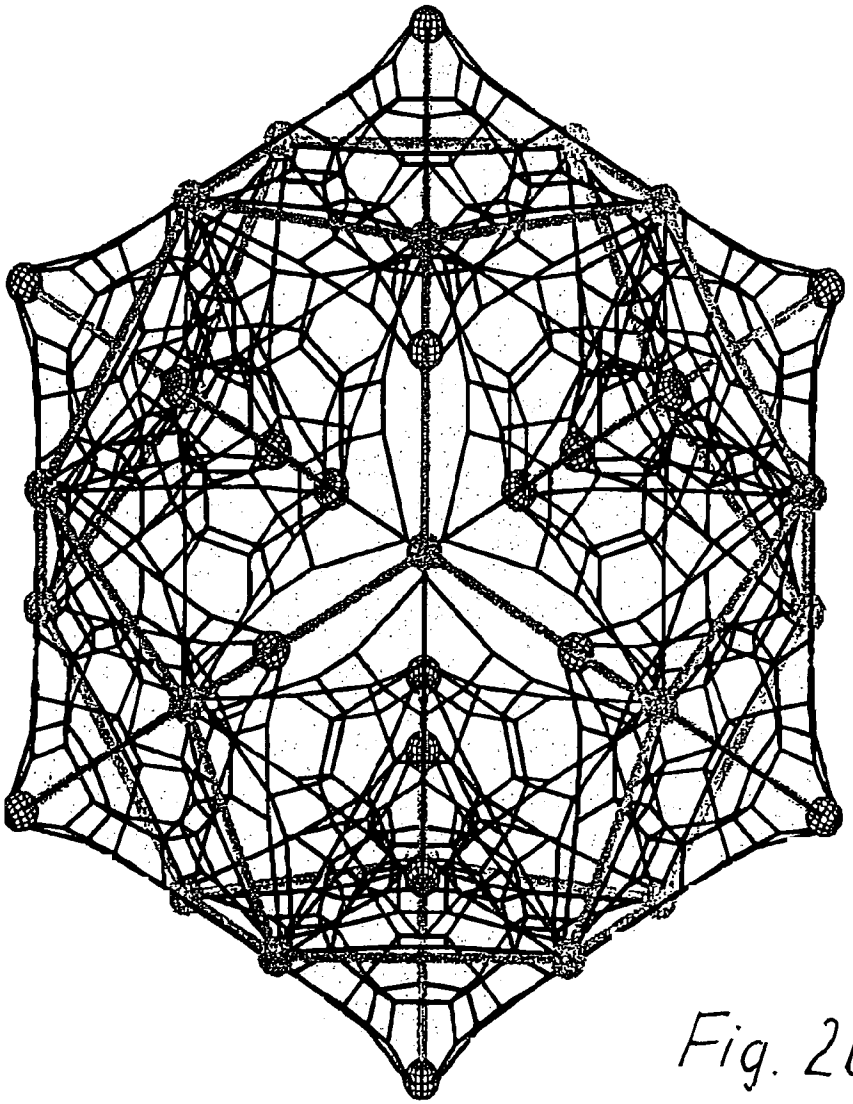

The rope game device according to FIGS. 15 and 16 is combined from six frame elements, that according to FIGS. 17 and 19 is combined from eight frame elements and that according to FIGS. 19 and 29 from nine frame elements.

Figure 21:
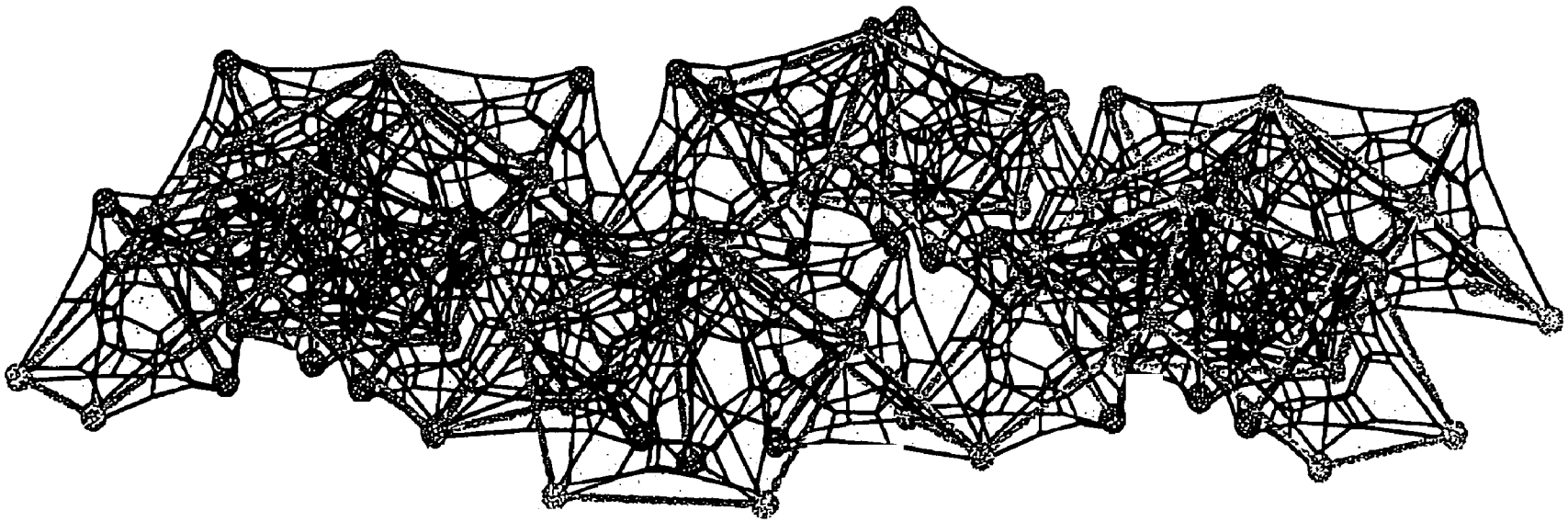
Figure 22:
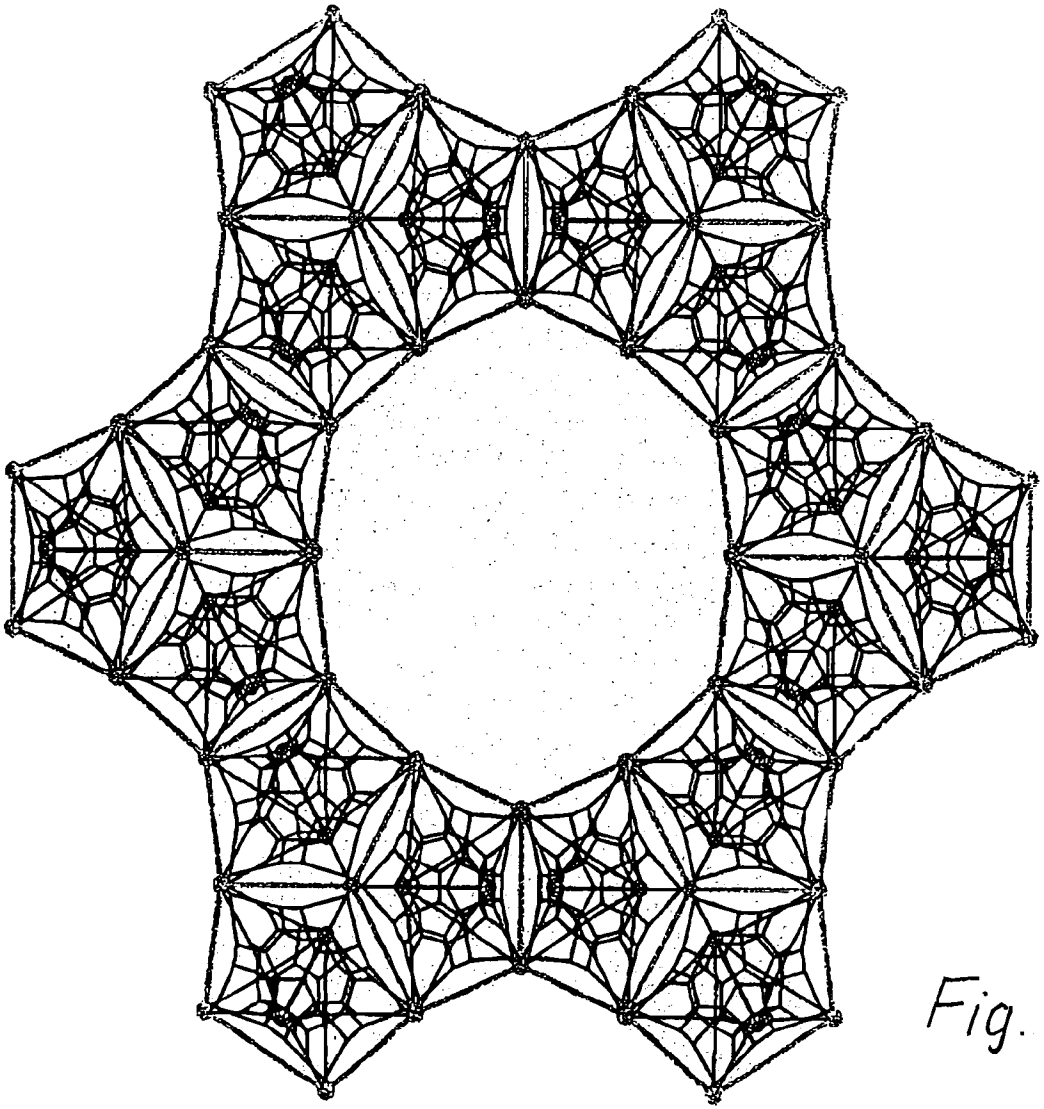

The example of FIGS. 21 and 22 shows, that the system can be infinitively combined. In the shown case six three-part combinations, of which each forms individually a tent form, are connected to a ring.

REFERENCE NUMERALS LIST

1 Frame element (frame rod)
2 Hollow ball connector
3 3-dimensional net
4 Pressure rod
5 2-dimensional net
6 Guys

The invention claimed is:

1. Rope game device comprising a support frame and rope nets rigged within the support frame, wherein the support frame comprises a plurality of frame elements connected in series with each other, each of said frame elements composed of frame rods living in a single plane, adjoining sides of connected frame elements sharing a common frame rod, wherein at least one of said frame elements is a pentagonal frame element, each of said frame elements comprising a separate rope net rigged therewithin, the rope net having an upper rope net knot point residing outside one side of said single plane and a lower rope net knot point residing outside the other side of said single plane, the upper and lower knot points being separated in tension from each other via a pressure rod disposed therebetween.

2. Rope game device according to claim 1, wherein the rope net is formed by a 3-dimensional net.

3. Rope game device according to claim 1, wherein the rope net is formed by at least one 2-dimensional net.

4. Rope game device according to claim 1, wherein ends of the pressure rod are anchored by guys extending to knot points of the support frame.

5. Rope game device according to claims 1, wherein the frame rods of the support frame are connected to each other at support frame knot points, the support frame knot points being formed as hollow ball connectors.

6. Rope game device according to claim 4, wherein the pressure rod ends are connected to the guys at the respective upper and lower net knot points, the net knot points being formed as hollow ball connectors.

* * * * *

UNITED STATES PATENT AND TRADEMARK OFFICE

CERTIFICATE OF CORRECTION

PATENT NO. : 7,052,437 B2
APPLICATION NO. : 10/470339
DATED : May 30, 2006
INVENTOR(S) : Karl Heinz Kohler It is certified that error appears in the above-identified patent and that said Letters Patent is hereby corrected as shown below:

On the Title Page, item [73]:
Assignee name: Berliner Seilfabarik GmbH & Co.
Corrected to: : Berliner Seilfabrik GmbH & Co.

Signed and Sealed this

Seventeenth Day of April, 2007

JON W. DUDAS
*Director of the United States Patent and Trademark Office*